US011439220B2

(12) United States Patent
Hejjaoui et al.

(10) Patent No.: US 11,439,220 B2
(45) Date of Patent: Sep. 13, 2022

(54) DISPENSER FOR FLUID COSMETIC PRODUCTS

(71) Applicant: L'OREAL, Paris (FR)

(72) Inventors: Diana Hejjaoui, Clichy (FR); Maxim Stimpfling, Clichy (FR); Julien Hameau, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 17/260,292

(22) PCT Filed: Jul. 15, 2019

(86) PCT No.: PCT/EP2019/069046
§ 371 (c)(1),
(2) Date: Jan. 14, 2021

(87) PCT Pub. No.: WO2020/016196
PCT Pub. Date: Jan. 23, 2020

(65) Prior Publication Data

US 2021/0289922 A1 Sep. 23, 2021

(30) Foreign Application Priority Data

Jul. 17, 2018 (FR) ..... 18 56599

(51) Int. Cl.
*A45D 40/24* (2006.01)
*A45D 34/04* (2006.01)
(Continued)

(52) U.S. Cl.
CPC ..... *A45D 40/24* (2013.01); *A45D 34/04* (2013.01); *B05B 11/0078* (2013.01);
(Continued)

(58) Field of Classification Search
CPC .. A45D 40/24; A45D 34/04; A45D 2200/055; A45D 34/00; A45D 2200/058;
(Continued)

(56) References Cited

U.S. PATENT DOCUMENTS 2,001,819 A * 5/1935 Elle ..... B65D 83/0044 222/320
2,487,642 A * 11/1949 De Waltoff ..... B65D 83/0016 222/320
(Continued)

FOREIGN PATENT DOCUMENTS

FR 2864431 A1 7/2005
FR 2983046 B3 3/2014
(Continued)

OTHER PUBLICATIONS

International Search Report dated Oct. 10, 2019 in PCT/EP2019/069046 filed Jul. 15, 2019.

*Primary Examiner* — Patrick M. Buechner
(74) *Attorney, Agent, or Firm* — Oblon, McClelland, Maier & Neustadt, L.L.P.

(57) ABSTRACT

An assembly for packaging and dispensing of fluid cosmetic products includes, a threaded axial rod cooperating with a first piston and a second piston that are able to be moved in axial translation inside a tubular container in opposite directions under the effect of a rotation of said rod, the rod being a hollow rod forming at least part of an axial conduit between a bottom of the container and an outlet orifice for the products, the axial rod cooperating in rotation with said dispensing head in such a way that a relative manual rotation
(Continued)

Figure 1:
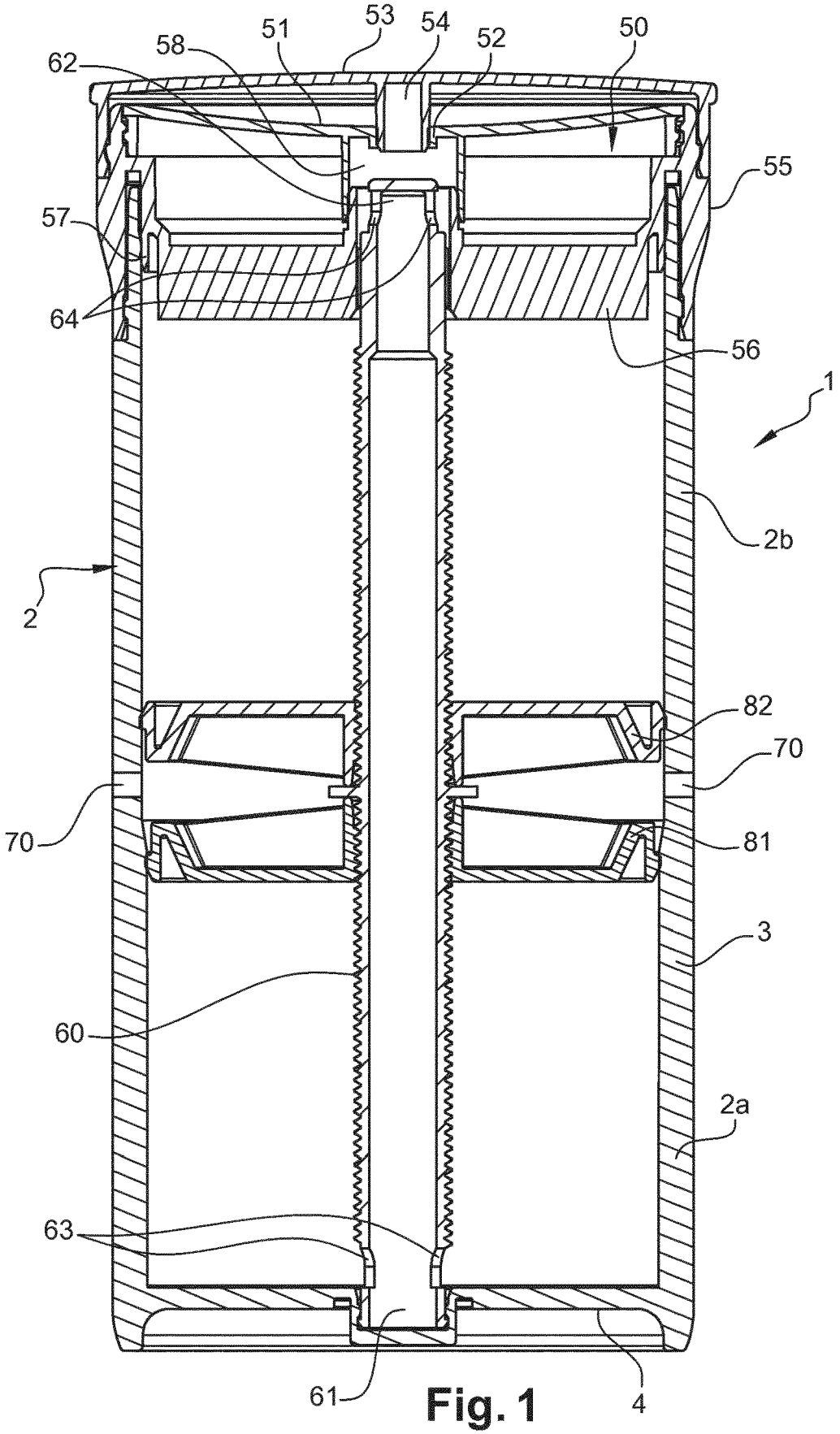

of said application head with respect to the container drives a movement of said first piston toward the bottom of the container.

11 Claims, 2 Drawing Sheets

(51) Int. Cl.
*B05B 11/02* (2006.01)
*B05B 11/00* (2006.01)

(52) U.S. Cl.
CPC ..... *B05B 11/02* (2013.01); *A45D 2200/055* (2013.01); *A45D 2200/058* (2013.01)

(58) Field of Classification Search
CPC . B05B 11/0078; B05B 11/02; B65D 83/0005; B65D 83/0011; B65D 83/0016; B65D 83/0044; B65D 83/005; B65D 81/32; B65D 81/325; B65D 81/3255
See application file for complete search history.

(56) References Cited

U.S. PATENT DOCUMENTS

| | | | | | |
|---|---|---|---|---|---|
| 4,050,612 | A * | 9/1977 | Stone | B65D 83/0044 | 604/184 |
| 4,220,261 | A * | 9/1980 | White | B65D 81/325 | 222/320 |
| 5,174,475 | A * | 12/1992 | Day | A61K 31/56 | 514/867 |
| 5,217,145 | A * | 6/1993 | Haan | B65D 77/08 | 222/129 |
| 10,106,311 | B2 * | 10/2018 | Mekata | B65D 83/64 | |
| 2011/0068123 | A1 * | 3/2011 | Geiberger | B05B 11/3085 | 222/135 |
| 2011/0297704 | A1 * | 12/2011 | Esteve | A45D 34/00 | 222/405 |
| 2013/0299515 | A1 | 11/2013 | Geiberger | | |

FOREIGN PATENT DOCUMENTS

| | | | |
|---|---|---|---|
| FR | 3042393 | A1 | 4/2017 |
| WO | WO 2012/008667 | A1 | 1/2012 |

* cited by examiner

DISPENSER FOR FLUID COSMETIC PRODUCTS

The present invention relates to a dispenser of fluid cosmetic products, of the type comprising a longitudinal container provided with a side wall having an axial direction and an opening at its upper part forming a neck, a dispensing head and a threaded axial rod cooperating with at least one piston.

Such a dispenser is described in particular in document FR2864431A1.

More specifically, the threaded axial rod is a hollow rod forming an axial conduit ensuring a flow of said product from the bottom of the container to said dispensing head. Said axial rod cooperates in rotation with said dispensing head.

The rotation of said dispensing head, and more particularly of an outer ring of the latter, with respect to said container drives a movement of said piston toward the bottom of the container, which pushes the product through the hollow axial rod to the dispensing head.

A similar device is described in the document FR2983046B3 for supplying an application tip, and in the document FR3042393A1 for supplying a foam applicator.

As is described in the document US20130299515A1, especially in FIG. 5 and paragraph [0057], such a system can be modified to permit the dispensing of two products. To do this, the threaded axial rod comprises two portions with threads of inverse pitch designed in such a way that, when said rod is driven in rotation, a lower first piston moves in translation toward the bottom of the container, and an upper second piston moves in translation toward the dispensing head or application head.

Thus, the lower first piston defines, with a side wall of the container and the bottom of the container, a first chamber for packaging of a first cosmetic product, and the upper second piston defines, with a side wall and the dispensing head or application head, a second chamber for packaging of a second cosmetic product.

However, the document US20130299515A1 proposes driving the rod in rotation and the two pistons by pressing on the head of the dispenser, the depressing of said dispenser moving a ratchet wheel that drives the threaded rod in rotation.

Depending on the dispensing system used, this type of actuation and driving of the rod may not be practical or possible. This is especially the case when the dispensing head is equipped with an application member, or when the cosmetic products are to be dispensed into a collecting cup.

There is therefore a need for a more practical and ergonomic device.

To this end, the present application provides an assembly for packaging and dispensing of fluid cosmetic products, comprising:

- a tubular body forming a longitudinal container intended to contain said products, said tubular body comprising a side wall, an open upper end, and an opposite lower end closed by a bottom;
- a dispensing head sealing said upper opening and having at least one outlet orifice for the products;
- a threaded axial rod cooperating with a first piston able to be moved in axial translation inside said body under the effect of a rotation of said rod, said rod being a hollow rod forming at least part of an axial conduit between the bottom of said container and the outlet orifice of the dispensing head, said axial rod cooperating in rotation with said dispensing head in such a way that a relative manual rotation of said application head with respect to the container drives a movement of said first piston toward the bottom of the container,
- the assembly being characterized in that the threaded axial rod cooperates with a second piston arranged above the first piston and able to be moved in axial translation inside said body under the effect of the rotation of the rod toward the dispensing head in a direction counter to that of the first piston, at least one second conduit ensuring fluidic communication between the opening of the container and the outlet orifice of the dispensing head.

A "cosmetic product" is understood in particular to mean a composition as defined in Regulation (EC) No 1223/2009 of the European Parliament and of the Council of 30 Nov. 2009 relating to cosmetic products.

Thus, by providing such an assembly in which the two pistons are actuated by rotation of the dispensing head, a dispensing assembly is obtained that is easier to use and that is compatible with a dispensing head equipped with an applicator or a collecting cup.

In an advantageously complementary manner, the assembly comprises a removable cap for closing the dispensing head when not in use.

Preferably, the two conduits are in communication with at least one common outlet orifice.

More preferably, the two conduits open into an intermediate mixing chamber arranged in front of the common outlet orifice.

Advantageously, the tubular body has a lower part of substantially constant internal cross section over the course of the first piston, and an upper part of substantially constant internal cross section over the course of the second piston and as far as the upper opening, the internal cross section of the lower part being smaller than the internal cross section of the upper part.

In an advantageously complementary manner, the side wall has at least one through-orifice situated along the body between the first and second pistons when in an initial position. Preferably, the orifice is situated along the body substantially at the reduction of the internal cross section in the lower part of the body.

According to a first variant, the dispensing head carries at least one application member, the outlet orifice preferably opening out inside the application member in such a way as to supply the latter with cosmetic products. The application member may in particular be in the form of a block of foam, felt, etc.

Alternatively or in a complementary manner, the dispensing head has a collecting surface into which the outlet opening opens out, it being possible for said collecting surface to be slightly concave in order to form a collecting cup. Alternatively, the collecting surface can be flat.

Advantageously, the dispensing head comprises at least one outer ring mounted movably in rotation about the container and able to drive the rod in conjoint rotation. The presence of such a drive ring also makes gripping easier.

Advantageously, the threaded rod is maintained freely in rotation in the bottom and has at least one lateral collecting orifice near said bottom. Such a feature improves the stability of the assembly, which no longer depends solely on the connection between the dispensing head and the body.

More preferably, the threaded rod has a closed upper end having at least one lateral outlet orifice near said upper end. Such an arrangement improves the mixing of the two products before they leave the dispensing head.

Advantageously, the threaded rod is driven in rotation by at least one wheel that has a notched hub able to cooperate with complementary notches of the threaded rod, said notched hub having a number of notches greater than the number of notches of the rod, and the notches of the hub not cooperating with notches of the rod forming at least part of the second conduit between the outlet orifice of the dispensing head and the upper orifice of the body forming the container.

Figure 2:
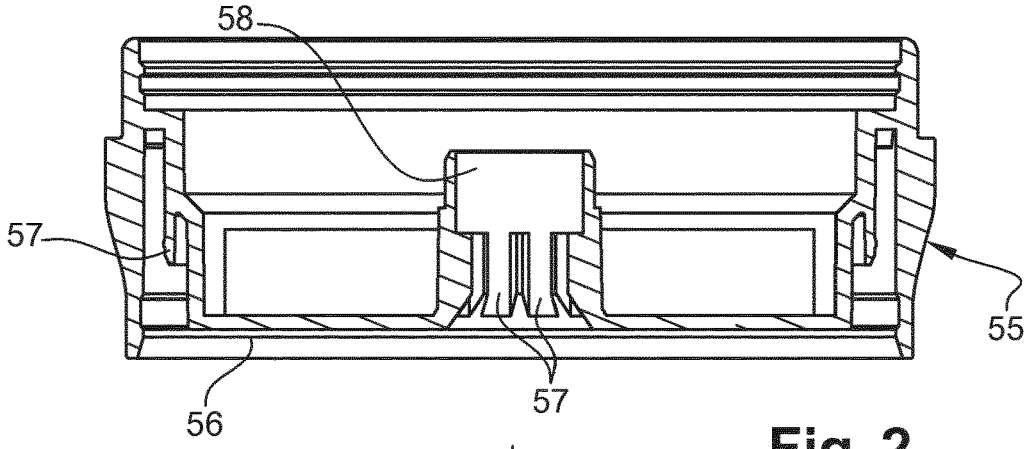
Figure 3:
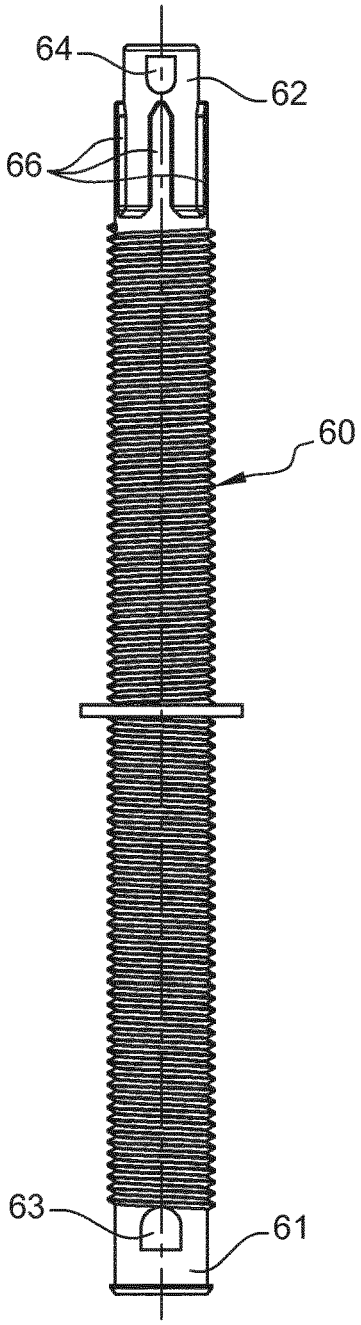

The invention will be better understood on reading the following description which is accompanied by non-limiting examples of use of the invention and in which reference is made to the attached drawing, in which:

FIG. 1 is a schematic longitudinal sectional view of a device according to the present application, FIG. 2 is a transverse sectional view of the outer ring with which the assembly from FIG. 1 is equipped, FIG. 3 is a detailed view of the hollow axial rod with which the assembly from FIG. 1 is equipped.

In the description, the orientations "upper" and "lower" are understood with reference to the longitudinal axis of the container relative to the dispensing head (top) and the bottom (foot) of the container.

FIG. 1 shows a packaging and dispensing assembly 1 according to the present application, comprising a tubular body 2 that forms a longitudinal container intended to contain said fluid cosmetic products. The tubular body 2 comprises a side wall 3, an open upper end, and an opposite lower end closed by a bottom 4.

The operating principle of such a device is widely described in the aforementioned documents.

The open upper end of the body 2 is equipped with a dispensing head 50 comprising an upper collecting cup 51 with a central orifice 52 for dispensing the cosmetic products. The dispensing head 50 is also provided with a removable cap 53 having a central stub 54 for plugging the orifice 52 of the cup when in the closed position.

The dispensing head 50 is mounted on the body 2 by way of an outer skirt that forms a drive ring 55 (FIG. 2). To do this, the dispensing head 50 is mounted freely in rotation by clip fastening, in particular by a bead/groove system. A non-return system can be provided so as to permit a single drive direction.

The outer skirt forming the drive ring 55 is rigidly connected to a central inner wheel 56 ensuring the closure of the orifice of the body 2 and having in particular for this purpose a peripheral sealing lip 57.

The wheel 56 has a notched hub for driving an axle formed by a hollow axial rod 60 extending inside the body 2 in the longitudinal direction of said body 2.

The axial rod 60 has a lower first end 61 fixed freely in rotation in the bottom 4 of the body, in particular by clip fastening. The axial rod 60 also has an opposite upper second end 62 intended to cooperate with the rotational drive system by way of the notched hub of the wheel 56.

To do this, the upper end 62 of the axial rod has a set of peripheral notches 66 matching the notches 57 of the hub of the wheel 56.

Advantageously, the hub of the wheel 56 has a number of notches 57 greater than the number of notches 66 of the axial rod 60, and the notches 57 of the hub not cooperating with notches of the rod 60 thus forming at least part of a conduit between the outlet orifice 52 of the dispensing head 50 and the upper orifice of the container-forming body 2 by way of the wheel 56.

As has been indicated, the axial rod 60 is a hollow rod forming a conduit between the bottom of the container and the dispensing head 50. To do this, the lower end 61 and upper end 62 of the rod 60 each have at least one lateral orifice 63, 64.

As is described in US20130299515, the axial rod 60 cooperates with a lower first piston 81 and an upper second piston 82, which are each able to be moved in axial translation inside said body 2 under the effect of a rotation of said rod in opposite directions, the first piston 81 moving toward the bottom 4 of the body 2, while the second piston 82 moves toward the dispensing head 50. To do this, the axial rod 60 has a lower thread and an upper thread of inverse pitch. The pistons 81, 82 are blocked in rotation by friction, in particular by way of a peripheral sealing lip coming into contact with an inner surface of the side wall 3.

In the initial position, as can be seen in the single figure, the pistons 81, 82 come into abutment either side of a central shoulder of the axial rod 60.

Thus, each piston 81, 82 defines, with the side wall 3, a chamber for packaging of a cosmetic product.

More specifically, the first piston 81 defines, with the side wall 3 and the bottom 4 of the body 2, a first chamber able to receive a first cosmetic product to be dispensed.

The second piston 82 defines, with the side wall 3 and the dispensing head 50, a second chamber able to receive a second cosmetic product.

The assembly 1 operates as follows.

When the user drives the outer ring 55 in rotation, he also drives the axial rod 60 by way of the wheel 56 and its notched hub. The rotation of the axial rod 60 then causes the movement of the pistons 81, 82 along the body 2 in their respective directions.

With the piston 81 moving in the direction of the bottom 4, it pushes the first cosmetic product through the orifices 63, then through the internal conduit of the hollow rod 60 as far as the lateral orifices 64.

With the second piston 82 moving toward the dispensing head 50 and more precisely toward a lower surface of the wheel 56 sealing the upper opening of the body 2, it also pushes the second cosmetic product through the notches of the hub of the wheel 56 that are not engaged with the notches of the axial rod 60.

Depending on the pitch chosen for each thread, it is possible to control the relative movements of each piston 81, 82 and thus the proportions of products recovered.

The orifices 64 of the axial rod 60 and the non-engaged notches of the hub of the wheel 56 each open into a mixing chamber 58 situated under the cup 51, said mixing chamber itself being in fluidic communication with the dispensing opening 52.

It will also be noted that, in order to balance the pressures between the inside and the outside of the body, the side wall 3 has through-orifices 70.

The cross section of the orifices 70 depends on the quantity of air to escape. It will be preferable in particular for the orifices to be of oblong cross section extending along the periphery of the side wall 3.

With a view to making packaging and filling of the container easier, provision is also made that the tubular body 2 has a lower part 2*a* of substantially constant internal cross section over the course of the first piston 81, and an upper part 2*b* of substantially constant internal cross section over the course of the second piston 82 and as far as the upper opening, the internal cross section of the lower part being smaller than the internal cross section of the upper part.

Thus, the packaging procedure commences by the lower part of the body 2 being filled with the intended quantity of cosmetic product. The axial rod 60 carrying the pistons 81, 82, in the initial position against the central abutment, is introduced into the body 2.

Since the upper part of the body is slightly wider than the diameter of the first piston 81, only the second piston 82 is in tight contact upon insertion of the axial rod 60 along the first part, the air escaping via the lateral orifices 70.

When the first piston 81 reaches the narrowing of the cross section, peripheral sealing is established. The second piston 82 is also sealed peripherally with the upper part of the body 2, and the second product can be packaged.

The orifices 70 will preferably be positioned at the reduction of the internal cross section in the lower part of the body, if appropriate in such a way as to permit maximum escape of air.

The dispensing head 50 is then put in place, thereby closing the upper orifice of the body 2 through which the latter has been filled with the different cosmetic products.

The invention claimed is:

1. An assembly for packaging and dispensing of fluid cosmetic products, comprising:

a tubular body forming a longitudinal container intended to contain said products, said tubular body comprising a side wall, an open upper end, and an opposite lower end closed by a bottom;

a dispensing head sealing said upper opening and having at least one outlet orifice for the products;

a threaded axial rod cooperating with a first piston able to be moved in axial translation inside said body under the effect of a rotation of said rod, said rod being a hollow rod forming at least part of an axial conduit between the bottom of said container and the at least one outlet orifice of the dispensing head, said axial rod cooperating in rotation with said dispensing head in such a way that a relative manual rotation of said application head with respect to the container drives a movement of said first piston toward the bottom of the container, the assembly wherein the threaded axial rod cooperates with a second piston arranged above the first piston and able to be moved in axial translation inside said body under the effect of the rotation of the rod toward the dispensing head in a direction counter to that of the first piston, at least one second conduit ensuring fluidic communication between the opening of the container and the at least one outlet orifice of the dispensing head.

2. The dispensing and packaging assembly as claimed in claim 1, further comprising a removable cap for closing the dispensing head when not in use.

3. The dispensing and packaging assembly as claimed in claim 1, wherein the tubular body has a lower part of constant internal cross section over the course of the first piston, and an upper part of constant internal cross section over the course of the second piston and as far as the upper opening, the internal cross section of the lower part being smaller than the internal cross section of the upper part.

4. The dispensing and packaging assembly as claimed in claim 1, wherein the side wall has at least one through-orifice situated along the body between the first and second pistons when in an initial position, said orifice being situated at a reduction of the internal cross section in the lower part of the body where appropriate.

5. The dispensing and packaging assembly as claimed in claim 1, in which said dispensing head carries at least one application member, the outlet orifice opening out inside the application member in such a way as to supply the latter with cosmetic products.

6. The dispensing and packaging assembly as claimed in claim 1, in which said dispensing head comprises at least one outer ring mounted movably in rotation about the container and able to drive the rod in conjoint rotation.

7. The dispensing and packaging assembly as claimed in claim 1, wherein the threaded rod is maintained freely in rotation in the bottom and has at least one lateral collecting orifice near said bottom.

8. The dispensing and packaging assembly as claimed in claim 1, wherein the threaded rod has a closed upper end with at least one lateral outlet orifice near said upper end.

9. The dispensing and packaging assembly as claimed in claim 1, wherein the threaded rod is driven in rotation by at least one wheel that has a notched hub able to cooperate with complementary notches of the threaded rod, said notched hub having a number of notches greater than the number of notches of the rod, and the notches of the hub not cooperating with notches of the rod forming at least part of the second conduit between the outlet orifice of the dispensing head and the upper orifice of the body forming the container.

10. The dispensing and packaging assembly as claimed in claim 1, wherein the two conduits are in communication with the at least one outlet orifice.

11. The dispensing and packaging assembly as claimed in claim 10, wherein the two conduits open into an intermediate mixing chamber arranged in front of the at least one outlet orifice.

* * * * *